US010780961B2

(12) United States Patent
Harman et al.

(10) Patent No.: US 10,780,961 B2
(45) **Date of Patent: *Sep. 22, 2020**

(54) METHOD OF ESTABLISHING COMMUNICATION FOR SUB-ICE SUBMARINE MISSIONS BETWEEN A SUB-ICE VESSEL AND A TERRESTRIAL FACILITY USING A LASER-POWERED ICE-PENETRATING COMMUNICATIONS DELIVERY VEHICLE

(71) Applicant: Stone Aerospace, Inc., Del Valle, TX (US)

(72) Inventors: John Harman, Keyser, WV (US); William C. Stone, Del Valle, TX (US)

(73) Assignee: Stone Aerospace, Inc., Del Valle, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/676,061

(22) Filed: Nov. 6, 2019

(65) Prior Publication Data

US 2020/0140046 A1 May 7, 2020

Related U.S. Application Data

(63) Continuation of application No. 16/265,504, filed on Feb. 1, 2019, now Pat. No. 10,518,854.

(60) Provisional application No. 62/625,159, filed on Feb. 1, 2018.

(51) Int. Cl.
*B63G 8/38* (2006.01)
*B63C 11/52* (2006.01)

(52) U.S. Cl.
CPC ..... *B63C 11/52* (2013.01); *B63G 8/38* (2013.01)

(58) Field of Classification Search
CPC ..... B63C 11/52; B63G 8/38; B63G 8/001; B63G 8/04
See application file for complete search history.

(56) References Cited

U.S. PATENT DOCUMENTS 5,319,376 A * 6/1994 Eninger ..... B63B 22/003 342/357.4
10,518,854 B2 * 12/2019 Harman ..... B25J 9/16
2017/0370154 A1 * 12/2017 Hogan ..... B23K 26/0648

* cited by examiner

*Primary Examiner* — Stephen P Avila
(74) *Attorney, Agent, or Firm* — Miguel Villarreal, Jr.; Gunn, Lee & Cave, P.C.

(57) ABSTRACT

A laser-powered ice-penetrating communications payload delivery vehicle for sub-ice submarine missions enables under-ice operations to exchange information with terrestrial facilities or satellite networks with communications methods otherwise blocked by an ice cap. The vehicle comprises an electronics bay, a payload bay, optics bay, and a melt optic with laser. The system and method of establishing communication where the vehicle, tethered to a sub-ice vessel, is released. The vehicle ascends to the bottom of an ice sheet and uses a laser to melt the ice, forming a borehole through which the vehicle continues to ascend. When buoyancy no longer advances the vehicle beyond sea level, the vehicle continues to melt a conical opening through the ice until unobstructed atmosphere is reached and bi-directional communication is established. Where the melting capacity cannot reach ice to continue melting, the vehicle mechanically advances itself toward the surface to establish high bandwidth, bi-directional communication.

6 Claims, 8 Drawing Sheets

METHOD OF ESTABLISHING COMMUNICATION FOR SUB-ICE SUBMARINE MISSIONS BETWEEN A SUB-ICE VESSEL AND A TERRESTRIAL FACILITY USING A LASER-POWERED ICE-PENETRATING COMMUNICATIONS DELIVERY VEHICLE

CROSS REFERENCE TO RELATED APPLICATIONS

This is a continuation application claiming priority to and the benefit of U.S. application Ser. No. 16/265,504, filed Feb. 1, 2019, which claims priority to and the benefit of U.S. provisional application Ser. No. 62/625,159, filed Feb. 1, 2018, and entitled "Laser-Powered Ice-Penetrating Communications Antenna for Sub-Ice Submarine Missions," both of which are hereby incorporated by reference herein.

STATEMENT REGARDING FEDERALLY SPONSORED RESEARCH OR DEVELOPMENT

None.

BACKGROUND OF THE INVENTION

1. Field of the Invention

The present invention relates to communication devices, and more specifically to laser-powered ice-penetrating communications delivery vehicles for sub-ice submarine missions.

2. Description of the Related Art

Currently, submarines deploy tethered buoyant communications antennas, which come to rest on the underside of the ice shelf. These antennas can receive radio communications from above the ice at very low bandwidth, but have no transmitting capability. The lack of transmitting capabilities is due to poor radio frequency (RF) propagation in the highly conductive sea water environment. Having only unilateral, low bandwidth communication with the surface represents a significant impairment of operational capability.

Accordingly, there is a need for a compact and rapidly deployable device that can deliver a communication payload (or other payload) through a thick ice sheet to the clear surface exposed to atmosphere, thus allowing high bandwidth, bi-directional communication between a sub-surface vehicle and command and control.

BRIEF SUMMARY OF THE INVENTION

The present invention overcomes the problem of how to establish high bandwidth, bi-directional communication through a thick ice sheet between a sub-ice vessel and a receiving and/or transmitting body located on the other side of the ice sheet.

The present invention is a laser powered, ice penetrating system with a vehicle that can deliver a communication payload (or other payload) through a thick ice sheet, through an overlying firn layer (snow left over from prior seasons and recrystallized into a substance denser than névé, which is partially melted, refrozen and compacted snow preceding ice formation), and to the clear surface exposed to atmosphere, thus allowing high bandwidth, bi-directional communication between satellite networks, ground level communication systems, and large under-ice vehicles.

The actuating force for such a delivery vehicle while below the level of the water surface is supplied by its buoyancy. Boring through the thick ice sheet is achieved through a direct-melt laser drilling apparatus, wherein optical energy is supplied to the delivery vehicle over a fiber optic tether from a sub-ice vessel, e.g., submarine. High energy light impinges directly on the ice, melting the ice, while the penetrator's buoyancy keeps the nose (or front end) in contact with the upper end of the borehole. Buoyancy is maintained through the use of buoyancy materials, such as syntactic foam, aerogel and other similar low density materials, which are concentrated near the forward end of the penetrator to keep the penetrator oriented vertically as the penetrator progresses. In this application, the terms "delivery vehicle" and "penetrator" are used synonymously.

Optical power from the sub-ice vessel is transferred to the penetrator, or delivery vehicle. A fiber laser unit supplies the required optical power for penetrating the ice. The laser operates in the 1-5 kW range and may be carried on board the sub-ice vessel, e.g., submarine. The laser supplies the power necessary to achieve rapid (e.g., 1 ft/min) ice penetration for a small diameter penetrator. Yet, even at this high level of power, the laser unit is compact enough to be installed practically aboard submarines with constrained hatch sizes and limited onboard space.

A fiber optic tether delivers the optical power to the buoyant penetrator. In one embodiment, the fiber optic tether is a multimode fiber optic tether. A commercially available laser unit of this power, with a typical armored process fiber, is the Ytterbium Laser System, Model YLS-1000 from IPG Photonics Corporation, though other comparable laser sources may also be used and remain within the contemplation of the present invention. The penetrator of the present invention utilizes a much smaller diameter buffered fiber, on the order of 0.040" diameter.

The fiber tether is stored in a launch tube attached to the external surface of the sub-ice vessel. When the buoyant penetrator is released from the sub-ice vessel, the fiber tether is passively deployed from the penetrator as the penetrator rises (via buoyancy action) through the water and/or ice.

The present invention melts the ice by applying laser power directly to the ice in front of the penetrator. The process fiber, originating from the sub-ice vessel, is terminated into an optics package inside the penetrator. The function of this optics package is to optimize the laser beam for ice penetration, first by passing the beam through a collimating optic, and then to a divergent optic to expand the beam on the ice directly impeding upward penetrator progress. The rate of penetration, for a given beam energy, follows an inverse square dependence on penetrator diameter. Consequently, holding the beam diameter at the minimum requisite dimension through precise collimation, and minimizing penetrator diameter, produces exponential gains in penetration rates.

A feature of the present invention is that melting of the ice is achieved by direct application of laser energy to the ice, rather than first converting this energy to heat (as in heated nose cone, hot water jetting, or hybrid designs). The use of 1070 nm wavelength laser light is important. At this wavelength optical energy is preferentially absorbed by solid ice as opposed to liquid water. This prevents, e.g., flashing of the water at higher power levels. Instead, through proper design of the optics chain, close to 100% of the optical power is deposited into a narrow cone just ahead of the penetrator and melting a hole having a diameter only slightly larger than the penetrator hull diameter. The result is significantly higher penetration rates compared to any other technology.

The use of focused 1070 nm radiation to create the melt hole produces several types of efficiency gains. First and foremost, using focused radiation eliminates a large amount of bulky hardware, translating to reduction in both penetrator length and diameter, the latter being paramount. Second, waste heat is greatly reduced, where waste heat is defined as unnecessary internal and shell heating in regions other than the penetrator nose. Particularly in environments where the ice is near phase change temperature, shell heating is largely wasteful, as heat does not need to be applied continuously to the borehole wall to allow passage of the aft end of the penetrator. Third, adopting a passive optics system to apply energy to the ice eliminates the need for pumps or other active hardware, reducing the penetrator's electrical onboard power budget and improving reliability. This, in turn, also reduces penetrator size and increases buoyancy, by reducing battery volume and weight.

Finally, adopting a direct laser melting system minimizes the need for intimate contact between the penetrator nose and the ice surface, since an optical mode of melting does not rely on direct contact to impart energy to the ice. This becomes especially significant when ascending through the ice and fern layer above sea level, as an ascending system may not keep the penetrator nose in continuous contact with the top of the borehole. This direct laser penetrator capability has been demonstrated in the laboratory using a 5 kW commercially available laser.

This ice melting system is relatively silent and does not utilize any energetic or pyrotechnic materials that would be hazardous to store or handle on the submarine, thus reducing the time to field this system. Further details of the direct application of laser energy to ice is found in U.S. Pat. No. 9,963,939 (Stone, et. al), entitled, "Direct Laser Ice Penetration System," and incorporated by reference herein.

The present invention may deliver a communication payload from a sub-ice environment to the ice surface in various manners. In one embodiment of the present invention, upon reaching the ice-water interface (i.e., the bottom surface of the ice sheet), the penetrator begins melting the ice directly in front of the penetrator using a laser. This direct impingement of the laser to the ice-water interface melts the ice, forming a borehole through which the penetrator may pass. The penetrator continues melting the ice while simultaneously conducting a buoyant ascent advancing upward toward sea level within the just-formed borehole within the ice sheet.

Once the buoyancy is no longer sufficient to continue the advancement of the penetrator upwards (i.e., beyond sea level toward the surface), the penetrator then anchors itself to the interior surface of the borehole. The laser melting system of the present invention continues to function, melting a conical hole through the ice and snow. At this point, communications is established via a telescopic antenna.

Should it prove necessary to move (advance) the penetrator from sea level upward towards the surface (including through the potential presence of a firn layer), an electrically driven mechanical ascending system is employed. Such an ascending system functions by lodging the penetrator in place in the borehole while a void is created in the ice in advance of the nose by the laser, and then relocating the penetrator upwards via an extending and retracting mechanism in the penetrator hull. Alternatively, the ascending system may include a traction mechanism.

In the former scenario, the penetrator is held in place by, for example, a series of 3 to 8 spring loaded cams on the outside perimeter of the penetrator that allows only upward motion. A small motor is employed to extend the forward section of the penetrator upward once the penetrator has melted some ice and developed sufficient headroom. The aft section is then retracted into the forward section (akin the locomotion of an inch worm), and the process repeats.

In the latter scenario, the penetrator employs a motor or motors to turn, for example, toothed wheels held pressed against the borehole walls by a biasing pressure, developing traction against the ice. The wheels are rotated continuously to hold the penetrator nose against the ice. Alternatively, the wheels are turned on intermittently with a ratcheting mechanism capturing progress.

Communication to and from the delivery vehicle is achieved by a much smaller, separate fiber optic line integrated into a single tether along with the power fiber. This hybrid tether could be used to send and receive commands to and from the delivery vehicle as well as transmit and receive operational communications to and from the antenna. The hybrid tether is deployed by the penetrator and does not require any action from the sub-ice vessel following deployment. The size of the payload delivered to the surface of the ice is dictated by parameters determined by specific concept of operations (CONOPS) and existing communications systems.

Onboard electrical power requirements for the delivery system are minimal. In an embodiment that does not incorporate an active ascent mechanism, electrical power is only required to drive onboard control electronics.

However, in another embodiment where an active ascent mechanism is utilized (i.e., an actuated ascending system), additional electrical power is required to lift the penetrator hull out of the water and upward through the borehole as the penetrator hull extends. However, since progress is captured by camming or ratcheting features on the outer diameter of the penetrator, power will only need to be applied intermittently. In an embodiment where the active ascent is performed via a traction mechanism, electrical power is required to turn the toothed wheels or tracks. The requisite power for modest ascents may be carried aboard in a compact battery bank, e.g., a lithium-ion battery stack, a fuel cell stack, etc.

It is an object of the present invention to provide for an expendable communications device for sub-ice vessels to communicate with external facilities.

It is another object of the present invention to provide for an expendable communications device configured to melt a borehole through an ice mass and traverse through the ice mass until the device reaches sea level.

It is another object of the present invention to provide for methods of locomotion that allow an expendable communications device to advance beyond sea level and upward toward the surface as the device melts a borehole through an ice mass.

The communications payload delivery system of the present invention is compact and deploys rapidly. The present invention represents a significant advance in tactical capability and fills a large operational void that has existed since submarines have been conducting under ice operations. Additionally, the ice melting system of the present invention is relatively silent and does not utilize any energetic or pyrotechnic materials that would be hazardous to store or handle on a sub-ice vessel, i.e., the submarine, thus reducing the time to field this system. The present invention advantageously does not utilize chemical heating (e.g., thermite or sodium or the like) resulting in safe handling and operations.

DETAILED DESCRIPTION OF THE INVENTION

Figure 1:
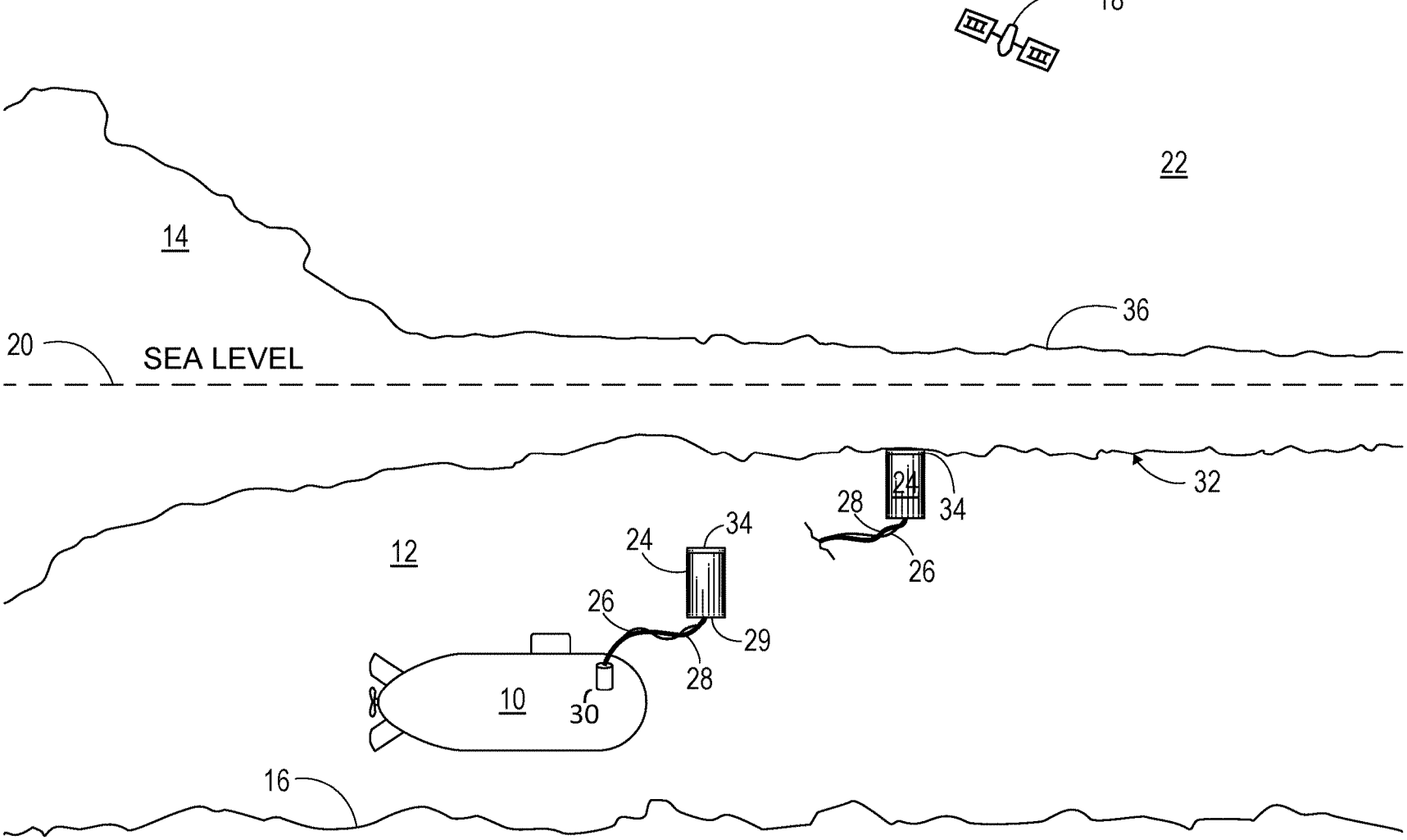
FIG. 1 shows an environmental view of an underwater vehicle under an ice mass and employing an embodiment of the present invention to establish communication with a satellite.

Referring to FIG. 1, sub-ice vessel 10 traverses ocean water 12 under ice shelf 14 (or ice mass 14, or ice sheet 14) and above ocean floor 16 in sub-freezing waters. Satellite 18 orbits above the earth in open atmosphere 22. Ice shelf 14 may extend several meters (e.g., 100 meters up to 1000 meters) above sea level 20, having substantial ice mass thickness between bottom surface 32 and ice surface 36 of ice shelf 14. Consequently, communication between sub-ice vessel 10 and satellite 18 is little to none, as it is difficult to transmit or receive a signal through ice shelf 14 in this harsh environment.

Communication delivery vehicle 24 is releasably engaged to sub-ice vessel 10. More particularly, communication delivery vehicle 24 is stored within launch tube 30 externally attached to sub-ice vessel 10. Communication delivery vehicle 24 is tethered to sub-ice vessel 10 via process fiber 28 (power fiber) and communication optic line 26. Desirous of establishing communication between sub-ice vessel 10 in the sub-ice environment and satellite 18 (or other communications apparatus or network) in open atmosphere 22, communication delivery vehicle 24 is released from launch tube 30 of sub-ice vessel 10.

Communication delivery vehicle 24 is comprised of a low density material, such as syntactic foam or aerogel (not shown), which provides substantial buoyancy to communication delivery vehicle 24. This buoyancy allows communication delivery vehicle 24, once released, to traverse ocean water 12 in an upward direction relative to sub-ice vessel 10, ascending until front end 34 of communication delivery vehicle 24 comes in contact with bottom surface 32 of ice shelf 14.

The buoyant material is concentrated at front end 34 of communication delivery vehicle 24 and maintains communication delivery vehicle 24 in an upright orientation as communication delivery vehicle 24 "floats" (ascends) toward bottom surface 32 of ice shelf 14. This same substantial buoyancy positively biases communication delivery vehicle 24 upward such that front end 34 of communication delivery vehicle 24 may maintain contact and press against bottom surface 30 of ice mass 14, as shown in FIG. 1.

Figure 2:
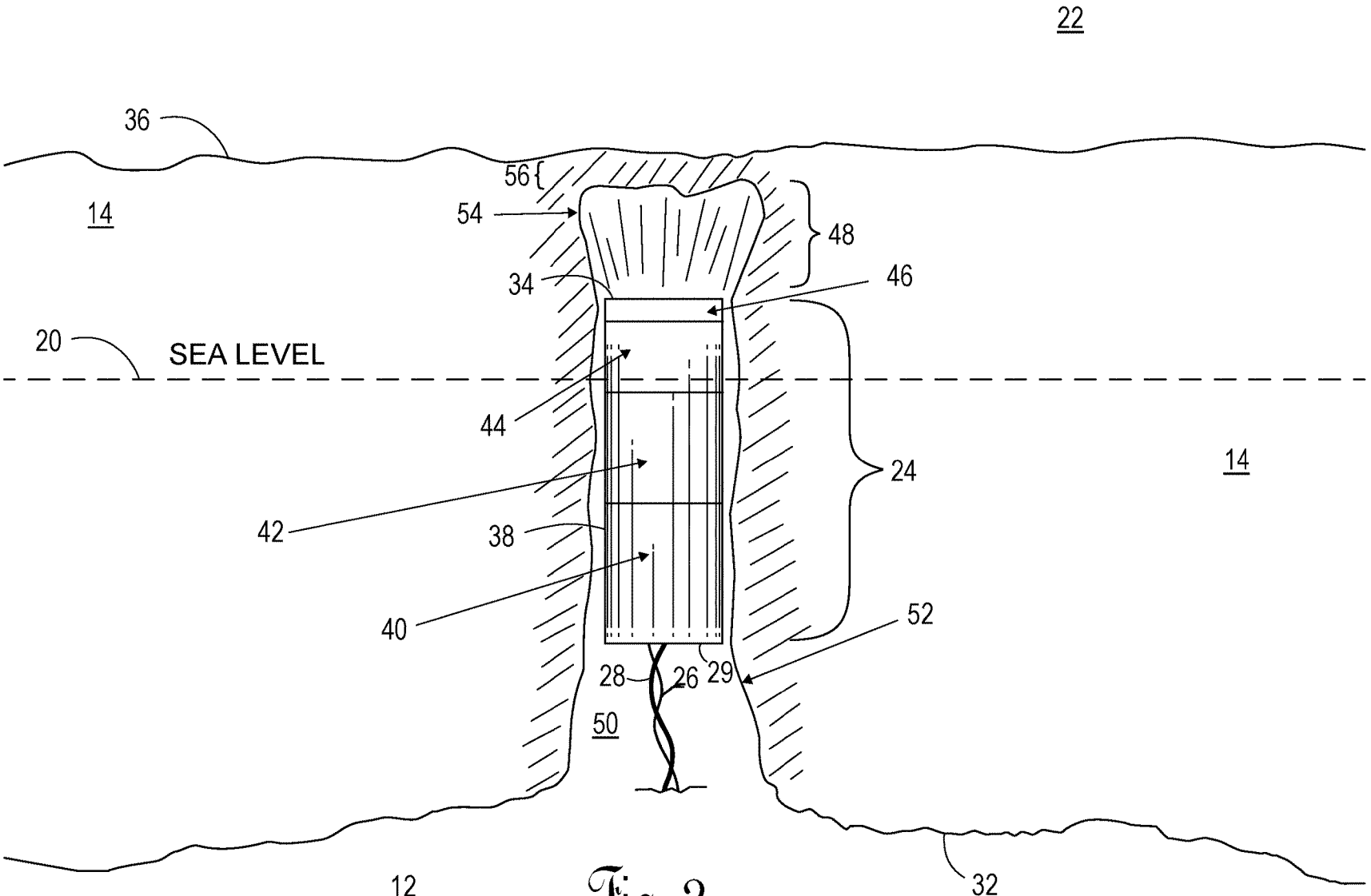
FIG. 2 depicts a cut out view of an embodiment of the present invention traversing an ice mass.

Referring now to FIG. 2, the communications payload delivery vehicle 24 (i.e., the ice penetrator) is comprised of housing 38 having front end 34 and back end 29. Several bays are safely secured and maintained within housing 38. These include electronics bay 40, payload bay 42, and optics bay 44. Payload bay 42 includes the communication payload, including the telescopic antenna. Optics bay 44 contains several components, including collimating optics and divergent optics.

A tether comprised of process fiber 28 and communication optic line 26 extends from back end 29 of communication delivery vehicle 24. In one embodiment, a fiber spooler (not shown) containing the tether comprised of process fiber 28 and communication optic line 26 may be located within sub-ice vessel 10. Alternatively, the fiber spooler may be located within communication delivery vehicle 24. In the case of the former, the tether unravels from the fiber spooler as the tether is pulled away from sub-ice vessel 10 as communication delivery vehicle 24 "floats" away. In the case of the latter, the tether unravels from the fiber spooler as the tether is released from communication delivery vehicle 24 as communication delivery vehicle 24 "floats" away from sub-ice vessel 10.

Process fiber 28 delivers optical power from a power source on sub-ice vessel 10 to communication delivery vehicle 24 to provide power to power consuming components of communication delivery vehicle 24, e.g., electronics and optics. Divergent optics 46 is positioned at front end 34.

Still referring to FIG. 2, communication delivery vehicle 24 is shown having reached bottom surface 32 of ice mass 14. With the path of communication delivery vehicle 24 toward ice surface 36 blocked by ice mass 14, communication delivery vehicle 24 begins to melt the ice at bottom surface 32.

Laser beam 48 transmitting from front end 34 of communication delivery vehicle 24 is used for ice penetration. First, laser beam 48 passes through a collimating optic and then to divergent optic 46 to expand laser beam 48 on the ice directly impeding upward penetrator progress. Communication delivery vehicle 24 melts through ice mass 14, forming borehole 50, a conical hole through the ice and snow, as shown in FIG. 2.

As communication delivery vehicle 24 continues to melt the ice, communication delivery vehicle 24 continues its buoyant ascent to sea level 20 within borehole 50. Upon reaching sea level 20, the buoyancy force is not sufficient to advance communication delivery vehicle 24 any further. Communication delivery vehicle 24 then ceases movement and anchors (or wedges) itself to borehole walls 52. The melting ice directly in front of laser beam 48 forms melt cavity 54 which enlarges as the ice melts.

The laser melting system of communication delivery vehicle 24 continues to function, melting the ice within melt cavity 54 directly in front of laser beam 48 and, ultimately, through remaining portion 56 of ice mass 14.

Figure 3:
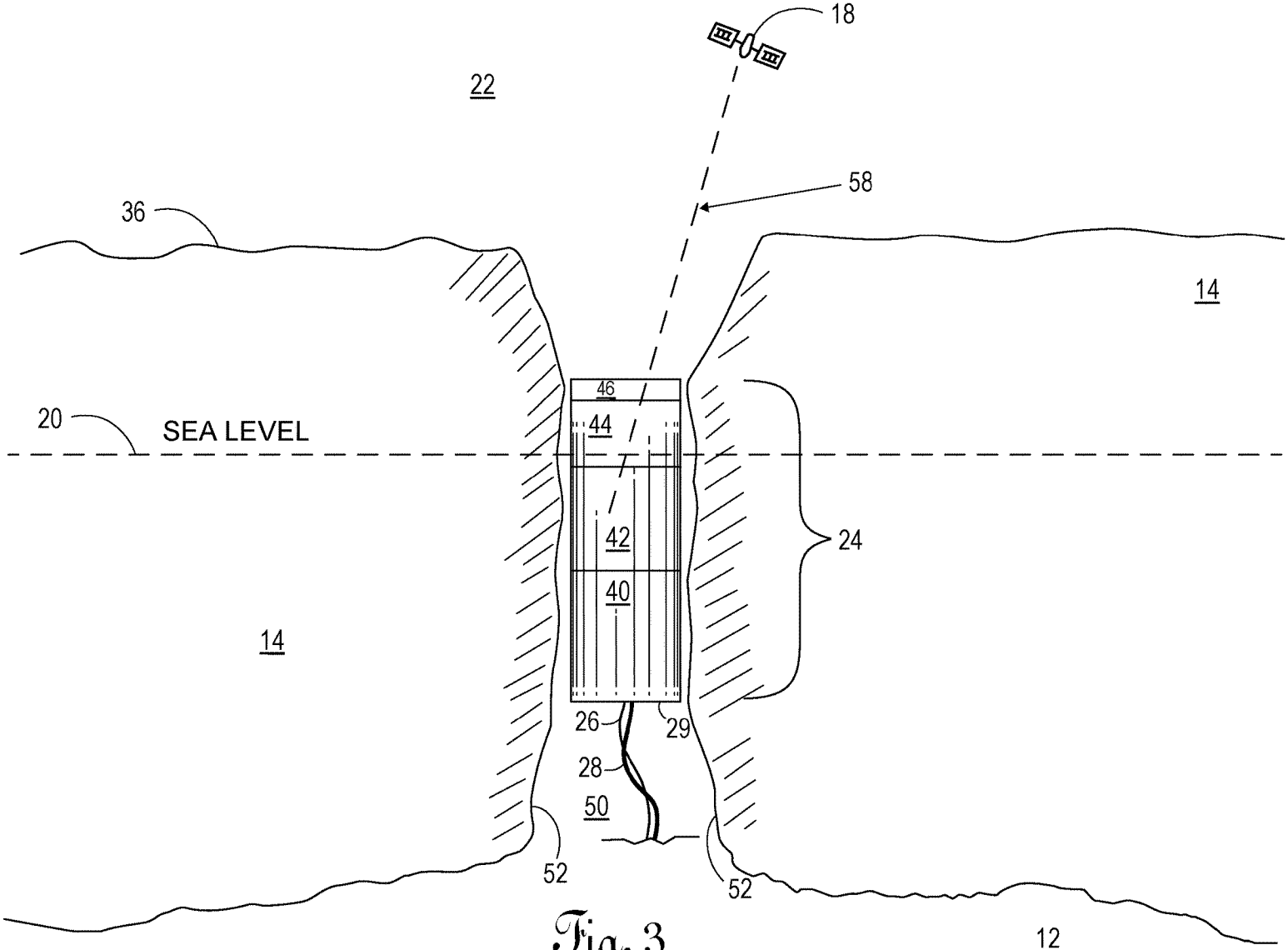
FIG. 3 shows a cut out view of an embodiment of the present invention having broken through the surface of an ice mass.

Referring now to FIG. 3, once remaining portion 56 has been cleared and there is unobstructed space in open atmosphere 22 between communication delivery vehicle 24 and, for example, satellite 18, communication is established via a telescopic antenna (not shown). With communication link 58 established, bilateral communications ensue between sub-ice vessel 10 and satellite 18 via communication delivery vehicle 24 and communication optic line 26.

One problem that may be encountered is that the optical nose (front end 34) of communication delivery vehicle 24 reaches ice surface 36 but the transmission antenna does not reach the surface. In this circumstance, a pyro charge or charges may be incorporated. For example, in another embodiment, and referring now to FIG. 4, once ice surface 36 is traversed physically and optically (leaving an open tube), but the transmission antenna (not shown) does not reach ice surface 36, pyro charge(s) 62 are used to "launch" an upper body portion 44 of communication delivery vehicle 24 out of borehole 50 and onto ice surface 36. Additionally, the pyro charge(s) may further function to break through a few meters of snow cap to get upper body portion 44 to ice surface 36.

Figure 4:
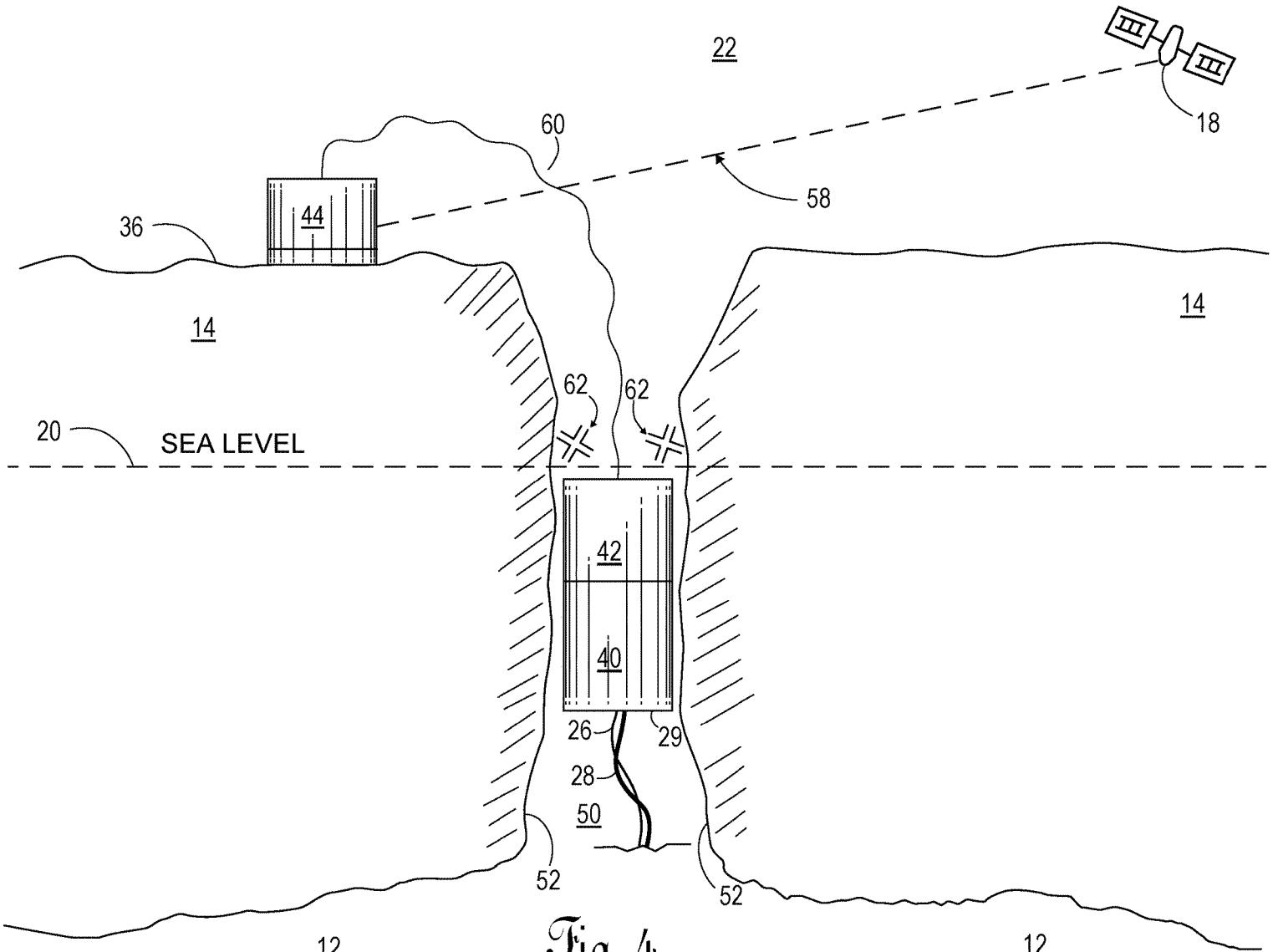
FIG. 4 depicts a cut out view of an embodiment of the present invention traversing an ice mass and using a pyro charge to establish communication with a satellite.

Still referring to FIG. 4, upper body portion 44 has a spooler thereon that keeps upper body portion 44 in contact with the communication delivery vehicle 24, but gets the antenna (not shown) out and away from borehole 50 and onto ice surface 36. Fiber-optic cable 60 is released from upper body portion 44 as upper body portion 44 is "shot" out of borehole 50 into open atmosphere 22 and lands nearby on ice surface 36. Communications between upper body portion 44 and satellite 18 are established through communication uplink 58. Communications between upper body portion 44 and communication delivery vehicle 24 are established via fiber optic cable 60. Communications between communication delivery vehicle 24 and sub-ice vessel 10 are established via communication optic line 26.

The communication delivery vehicle of the present invention may advance through ice mass 14 using longitudinal extension means or, alternatively, traction means. In the former, the present invention incorporates a telescopic member within the communication delivery vehicle which, when in an expanded position, separates slidably engaging housings, and when in an unexpanded position, allows the slidably engaging housings to come together. In the latter, the present invention incorporates traction means using a plurality of traction elements that serve to advance the ice penetrator upward regardless of whether solid ice, firn, or snow is in the upward pathway.

Figure 5:
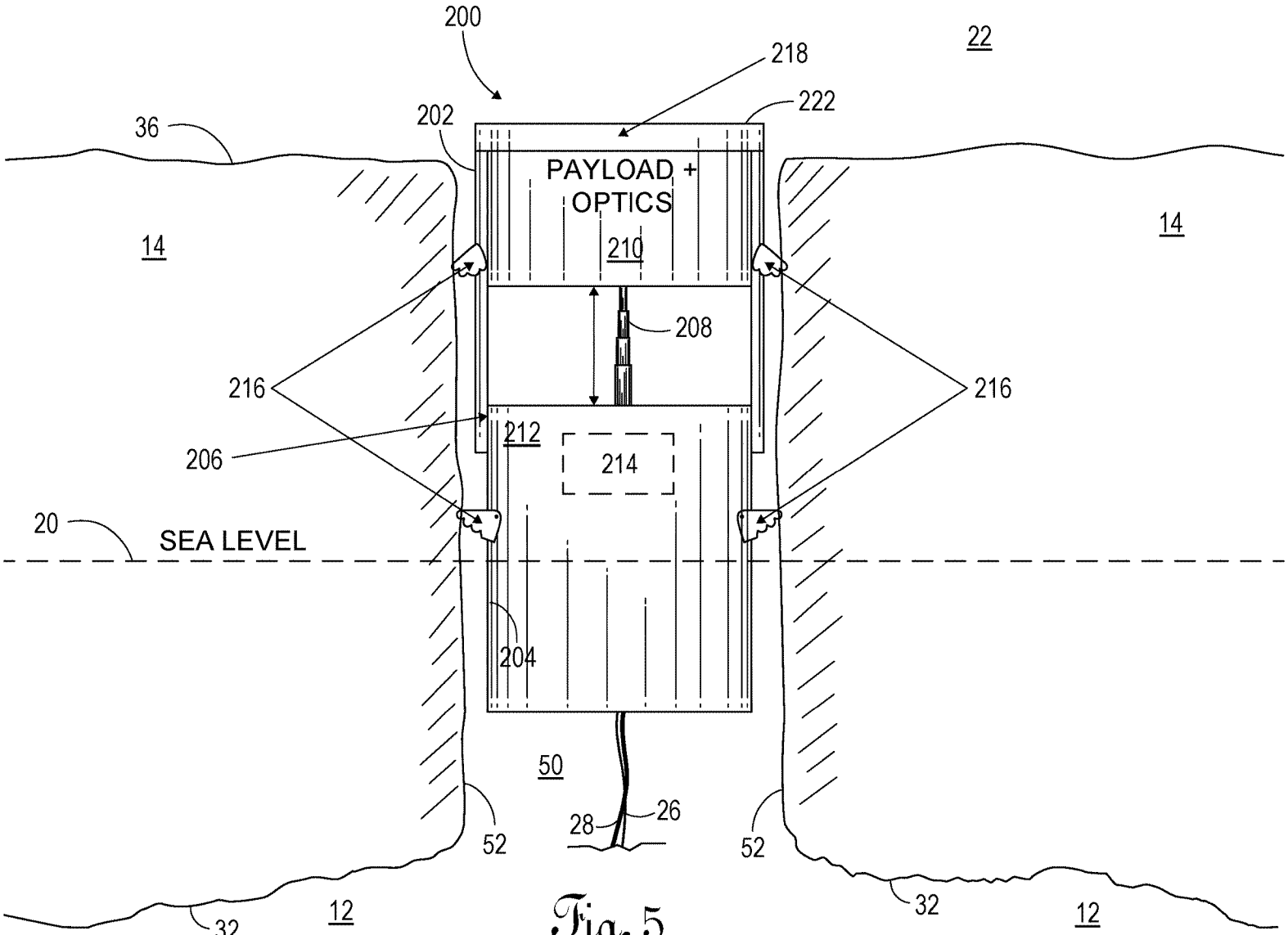
FIG. 5 shows a cut out view of an alternative embodiment of the present invention using cams and an extendable retracting member and having broken through the surface of an ice mass.

Referring now to FIG. 5, for example, in one embodiment using longitudinal extension means, the housing of communication delivery vehicle 200 includes external housing 202 and internal housing 204. External housing 202 and internal housing 204 are engagably slidable along a track 206. The outside of internal housing 204 has a fixed track (not shown) that mates with a corresponding track (not shown) on the inside surface of external housing 202, such that external housing 202 may slide away from internal housing 204 along the track 206 without completely separating from internal housing 204. A plurality of spring loaded cams 216 are located at equal spaced distances around and on external housing 202, and internal housing 204. Motor 214 drives the plurality of spring loaded cams 216.

In use, telescopic member 208 within the hull of communication delivery vehicle 200 extends distally from the penetrator hull in a linear fashion. As telescoping member 208 extends, such extending motion separates upper body 210 of communication delivery vehicle 200 from lower body 212 of communication delivery vehicle 200. When telescoping member 208 reaches the desired extension length (which may be preconfigured to variable lengths depending on the environmental conditions encountered), communication delivery vehicle 200 is held secured and anchored in place to borehole walls 52 by a plurality of spring loaded cams 216 that allow only upward motion, as shown in FIG. 5.

Laser beam via melt optic 218 located at front end 222 of communication delivery vehicle 200 continues to melt ice directly in front of communication delivery vehicle 200. Motor 214 is then employed to extend the forward section of communication delivery vehicle 200 upward once communication delivery vehicle 200 has developed sufficient headroom. Aft section 228 of communication delivery vehicle 200 is then retracted into the forward end 222, and the process repeats until communication delivery vehicle 200 breaches ice surface 36, establishing communication with satellite 18, as described above.

The cams operate separately such that when the telescopic member 208 extends upward, the cams on the internal housing 204 are biting into borehole wall 52 (to prevent internal housing 204 from being pushed down, descending into borehole 50) while the cams on external housing 202 are retracted. Once the extension is complete, the cams on external housing 202 bite onto borehole wall 52 to hold and secure communication delivery vehicle 200 at the higher elevation while the cams on internal housing 204 retract, allowing internal housing 204 to be pulled upward into external housing 202.

The present invention preferably uses 3 to 8 spring loaded cams, though a different number of spring loaded cams may be used and still remain within the contemplation of the present invention. Motor 214 used in the present invention is a small, commercially available motor.

Figure 6:
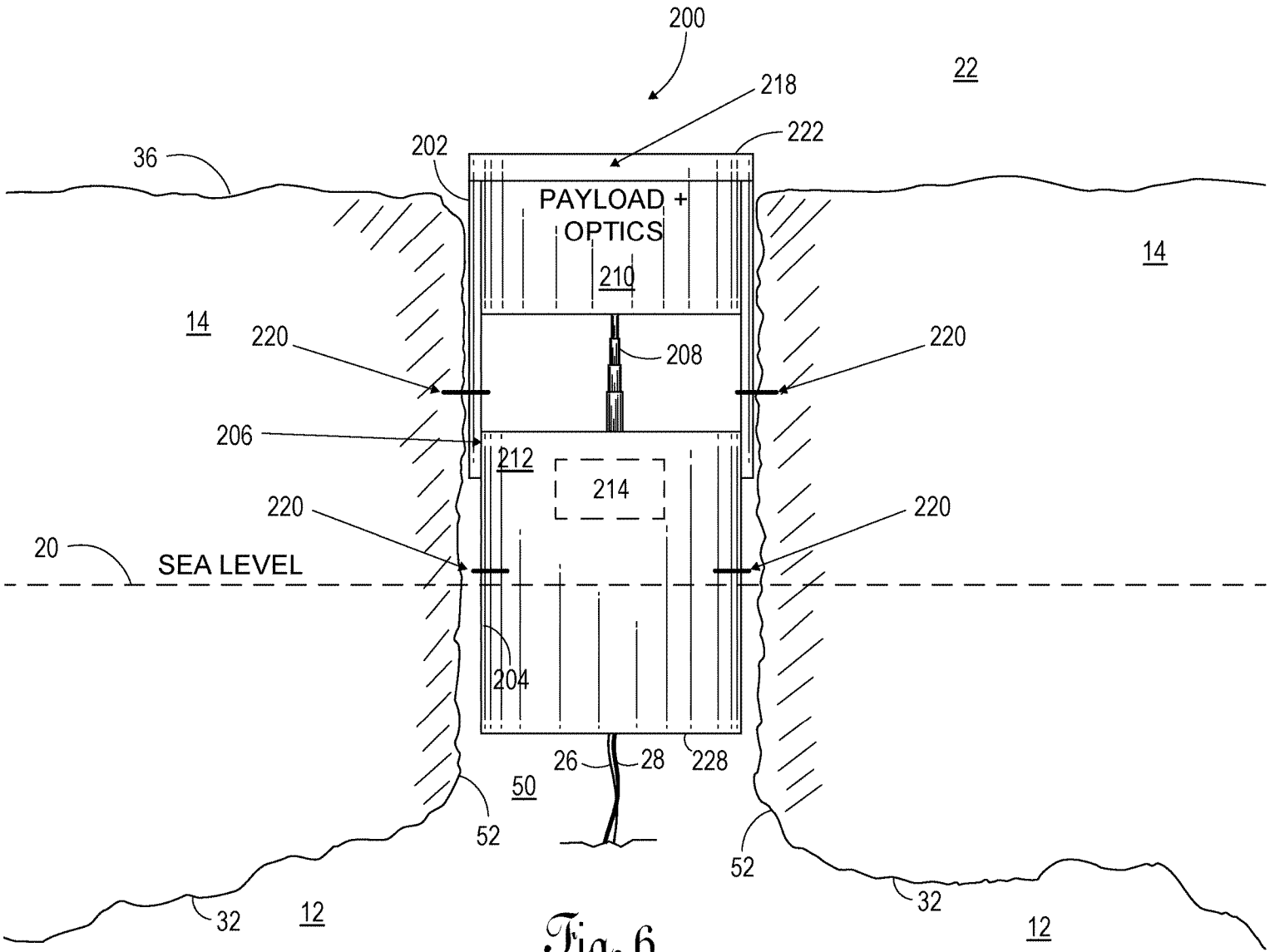
FIG. 6 depicts a cut out view of an alternative embodiment of the present invention using retractable pins and an extendable retracting member and having broken through the surface of an ice mass.

In another embodiment using longitudinal extension means, and referring now to FIG. 6, the plurality of spring loaded cams (FIG. 5) is replaced by a plurality of retractable pins 220 and functions similarly to the embodiment using the telescopic member, as described above.

Figure 7:
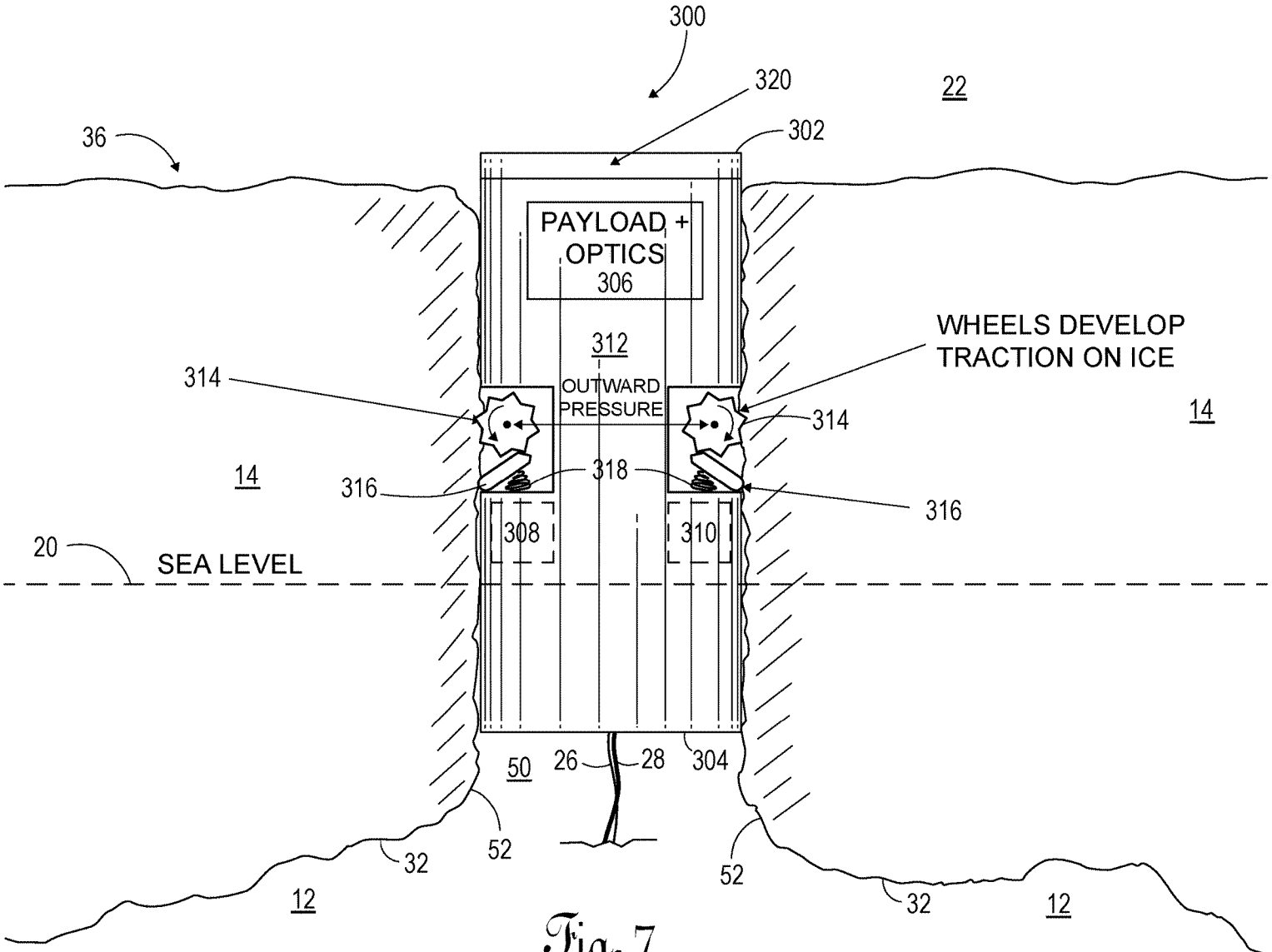
FIG. 7 is a cut out view of an alternative embodiment of the present invention using a wheel and ratcheting mechanism and having broken through the surface of an ice mass.

In an embodiment using traction means, and referring now to FIG. 7, a motor 308 (or motors 308 and 310) are used to turn toothed wheels 314 held against borehole walls 52 by biasing pressure, e.g., spring 316, developing traction against the ice along surface of borehole walls 52. Toothed wheels 314 are rotated continuously to hold front end 302 against the ice directly in front of communication delivery vehicle 300. Alternatively, tooth wheels 314 are turned on intermittently (with ratcheting mechanism 316 capturing upward advancing progress). Communication delivery vehicle 300 then continues advancing forward and melting ice using payload/optics 306 contained within hull 312 until communication delivery vehicle 300 breaches ice surface 36, allowing communication with satellite 18 to be established.

Figure 8:
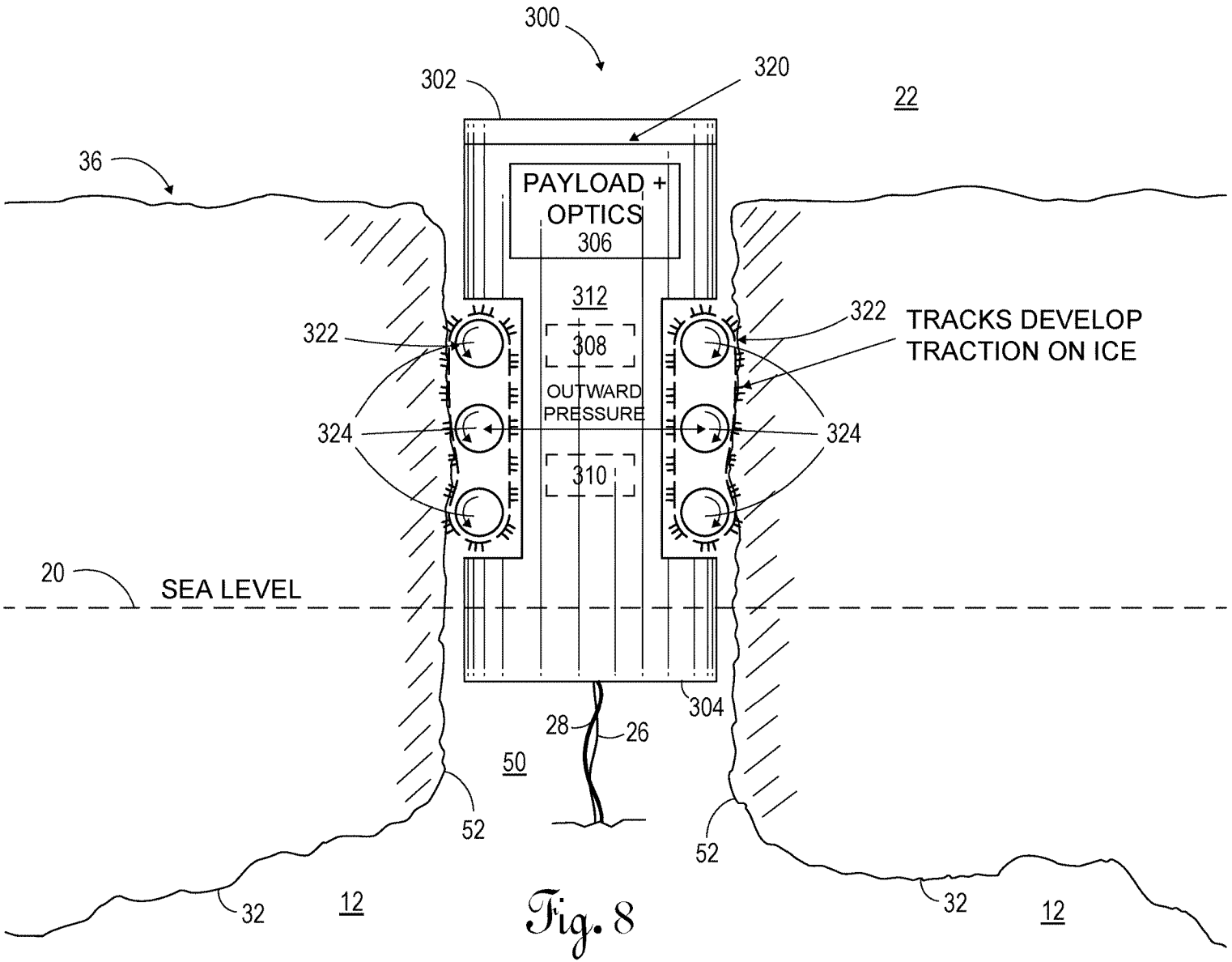
FIG. 8 is a cut out view of an alternative embodiment of the present invention using a continuous tank track or caterpillar track mechanism and having broken through the surface of an ice mass.

Referring now to FIG. 8, in another embodiment employing traction means, a plurality of caterpillar type treads 322 (vertically oriented at equal spacing about the perimeter of communication delivery vehicle 300) extend outward from the core of communication delivery vehicle 300. The plurality of motor driven tracks 322 makes contact with the interior surface of borehole wall 52. Outward pressure from within hull 312 biases motor driven tracks 322 against the interior surface of borehole walls 52 to maintain contact with the interior surface of borehole walls 52. This outward pressure against motor driven tracks 322 allow the individual tracks to "bite" on to the ice to provide traction for further upward advancement of communication delivery vehicle 300.

The plurality of motor driven tracks 322 are driven by a drive servo or drive sprocket 324 (similar to the rotating wheel). Preferably, three (3) drive sprockets are used for stability. In using a single wheel or drive sprocket in the caterpillar type tread, the single wheel can fail and will just spin if a void is encountered. The caterpillar tread of the plurality of motor driven tracks 322, however, spreads the contact surface out providing better traction and stability.

Once traction is established, communication delivery vehicle 300 then continues advancing forward and melting ice using melt optic 320 and payload/optics 306 contained within hull 312 until communication delivery vehicle 300 breaches ice surface 36, allowing communication with satellite 18 to be established.

The various embodiments described herein may be used singularly or in conjunction with other similar devices. The present disclosure includes preferred or illustrative embodiments in which a system and method for a laser-powered ice-penetrating communications apparatus for sub-ice submarine missions are described. Alternative embodiments of such a system and method can be used in carrying out the invention as claimed and such alternative embodiments are limited only by the claims themselves. Other aspects and advantages of the present invention may be obtained from a study of this disclosure and the drawings, along with the appended claims.

We claim:

1. A method of establishing communication between a sub-ice vessel and a terrestrial facility, said method comprising the steps of:

releasing a communications payload delivery vehicle from said sub-ice vessel, said communications payload delivery vehicle having buoyancy, and wherein said communications payload delivery vehicle comprises:

a housing;

an optics bay within said housing and containing beam optics;

a laser housed within said optics bay and having divergent optics configured for impingement of a laser beam directly on ice;

a payload bay within said housing and in optical communication with said optics bay and said divergent optics;

a payload within said payload bay;

an electronics bay within said housing and in optical communication with said optics bay, said divergent optics and said payload bay;

electronics within said electronics bay;

a power source within said housing and in optical communication with said optics bay, said divergent optics, said payload bay and said electronics bay; and at least one fiber optic cable in optical communication with said power source, said optics bay, said divergent optics, said payload bay and said electronics bay;

ascending from said sub-ice vessel until contact is made with the subsurface of an ice mass;

boring through said ice mass creating a borehole through said ice mass;

continuing to ascend within said borehole formed until said buoyancy of said communications payload delivery vehicle is not sufficient to further advance said communications payload delivery vehicle toward a top surface of said ice mass;

anchoring to the interior of said borehole formed;

melting remaining portion of said ice mass; and establishing communications with at least one external communication device; wherein said communications are high bandwidth and bi-directional.

2. The method of claim 1, wherein said boring step further comprises melting of ice in front of said communications payload delivery vehicle, said melting of ice performed via direct impingement of said laser beam directly on said ice.

3. The method of claim 2, wherein said communications payload delivery vehicle is laser-powered.

4. The method of claim 3, further comprising, if, following said melting step, said top surface of said ice mass is not reached, launching a portion of said communications payload delivery vehicle with at least one pyro charge, said portion of said communications payload delivery vehicle being launched out of said borehole and onto said surface of said ice mass.

5. The method of claim 3, wherein said continuing to ascend step further comprises employing an electrically driven extending and retracting mechanism for advancing movement of said payload delivery vehicle within said borehole beyond said buoyancy toward said top surface of said ice mass.

6. The method of claim 3, wherein said continuing to ascend step further comprises employing a traction mechanism for advancing movement of said payload delivery vehicle within said borehole beyond said buoyancy toward said top surface of said ice mass.

* * * * *